United States Patent [19]

Plaza et al.

[11] 4,049,109

[45] Sept. 20, 1977

[54] PRINT MEMBER CARRIAGE ASSEMBLY

[75] Inventors: Mario G. Plaza, Fremont; Richard D. Trezise, Newark, both of Calif.

[73] Assignee: Xerox Corporation, Stamford, Conn.

[21] Appl. No.: 664,789

[22] Filed: Mar. 8, 1976

[51] Int. Cl.[2] ..... B41J 1/24

[52] U.S. Cl. ..... 197/53; 197/60; 197/82

[58] Field of Search ..... 197/1 R, 16, 18, 49, 197/60, 53-55, 82

[56] References Cited

U.S. PATENT DOCUMENTS

| | | | |
|---|---|---|---|
| 3,400,798 | 9/1968 | Smith | 197/1 R |
| 3,509,980 | 5/1970 | Loughry et al. | 197/1 R |
| 3,707,214 | 12/1972 | Ponzano | 197/53 |
| 3,845,850 | 11/1974 | Herr et al. | 197/1 R |
| 3,855,448 | 12/1974 | Hanagata et al. | 197/1 R X |
| 3,882,985 | 5/1975 | Liles | 197/1 R |

*Primary Examiner*—Edgar S. Burr

*Assistant Examiner*—Paul T. Sewell

*Attorney, Agent, or Firm*—M. J. Colitz; T. J. Anderson; B. P. Smith

[57] ABSTRACT

A carriage assembly for transporting a print member along a predetermined path adjacent a support member comprises a first carriage section adapted to be mounted adjacent the support member for movement along the predetermined path, apparatus for mounting a print member to the first carriage section for movement between first and second positions relative to the support member, and apparatus coupled to the mounting apparatus for retaining a print member mounted to the frame in each of its first and second positions. The retaining apparatus includes a biasing member for biasing the print member in a direction opposite its second position when at its first position and in a direction opposite its first position when at its second position. The biasing member preferably includes an over-center tensioned spring coupled between the first carriage section and the mounting apparatus.

8 Claims, 3 Drawing Figures

PRINT MEMBER CARRIAGE ASSEMBLY

BACKGROUND OF THE INVENTION

This invention relates to carriage assemblies and, more particularly, to carriage assemblies for transporting a print member along a predetermined path adjacent a support member.

Carriage assemblies of the above general type have been used for decades in connection with printers and typewriters. The print members utilized over the years have included type bars, type balls, wire matrix print heads and, most recently, print wheels. The most common form of print wheel now in use is the so-called "daisy wheel" which is characterized by a plurality of character elements supported on a respective plurality of spokes extending radially from a central rotatable hub. Examples of printers which include daisy wheel print wheels are the HyTYPE I and HyTYPE II serial printers manufactured by Diablo Systems, Inc. of Hayward, California, and an example of an electronic typing system utilizing a daisy wheel printer is the Xerox 800 electronic typing system manufactured by the Xerox Corporation of Dallas, Texas.

In contemporary electronic printers utilizing print wheels, provision must be made not only for controlled rotation of the print wheel when located at a first or printing position adjacent the support platen, but also for movement of the print wheel as a unit between such printing position and a second or loading position spaced sufficiently from the platen so that the print wheel may be manually removed from the carriage and replaced with a different wheel. This might be necessary if the print wheel has become worn during prolonged use, or where a print wheel bearing a different font of characters is desired for printing.

Accordingly carriage assemblies used in contemporary print wheel type printers have generally included a first carriage section mounted adjacent the support platen on a pair of rails for movement along a predetermined path parallel to the axis of the platen. The print wheel is coupled to the shaft of a drive motor which is mounted to a second carriage section. The second carriage section is, in turn, pivotably mounted to the first section for movement between first and second positions respectively corresponding to the printing and loading positions of the print wheel. A latching mechanism is normally employed to retain the second carriage section at its first and second positions.

The latching mechanisms most often used have suffered from a number of disadvantages. First, they are subject to jamming when restoring the print wheel to its printing position. Second, the printer might accidentally be operated without the latch being closed and thereby cause print failure and possible part damage. Third, the latching mechanisms are relatively complex and costly.

It would be desirable, therefore, to provide a more effective means of retaining the print wheel in each of its two positions, i.e., printing and loading, which is substantially free of the above-mentioned disadvantages.

SUMMARY OF THE INVENTION

In accordance with the present invention, a carriage assembly for transporting a print member, such as a print wheel, along a predetermined path adjacent a support member, such as a platen, is provided comprising a first carriage section adapted to be mounted adjacent the support member for movement along the predetermined path; means for mounting the print member to the first carriage section for movement between first and second positions relative to the support member; and means coupled to the means for mounting for retaining a print member mounted to the first carriage section in each of its first and second positions, the means for retaining including means for biasing the print member in a direction opposite its second position when at its first position and in a direction opposite its first position when at its second position.

In accordance with the preferred embodiment, the biasing means includes over-center spring means coupled in tension between the first carriage section and a second carriage section included in the means for mounting the print member to the first carriage section and pivotable, relative to the first carriage section in order to move the print member to its first and second positions. In this respect, the over-center spring means is operative to bias the second carriage section and thus the print member in a direction toward the first position of the printer member when located between such first position and a predetermined position intermediate the first and second positions, and in a direction toward the second position when located between such predetermined position and the second position. Appropriate stop means cooperate with the spring means for retaining the print member in each of its first and second positions.

These and other aspects and advantages of the present invention will be more completely described below with reference to the accompanying drawings.

DESCRIPTION OF THE PREFERRED EMBODIMENT

Figure 1:
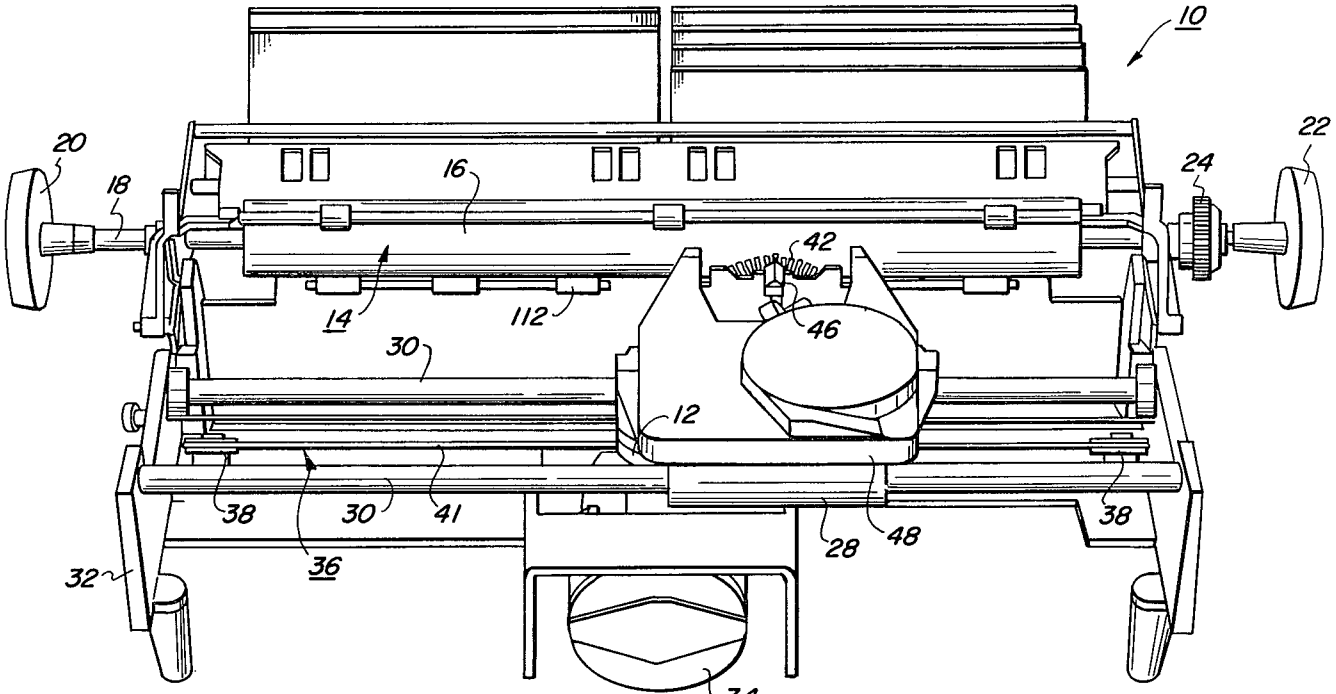
FIG. 1 is a front perspective view of a printer incorporating the unique carriage assembly of the present invention therein.

Referring to FIG. 1, a serial printer 10 is shown incorporating a carriage assembly 12 of the present invention which will be described in detail below. The printer 10 also includes a conventional platen feed assembly 14 which comprises a planten 16 mounted to a rotatable shaft 18 for rotation herewith. Mounted at each end of the shaft 18 are a pair of knobs 20 and 22 for enabling the manual rotation of the shaft 18 and platen 16. As is conventional, the knob 20 is fixed relative to the shaft and the knob 20 is movable axially of the shaft between first and second positions. When in a first position, a gear-drive assembly 24 mounted about the shaft 18 adjacent the knob 22 is engaged with the shaft so that a motor-gear arrangement (not shown) coupled to the gear-drive assembly 24 controls the automatic rotation of the shaft 18. When in a second position, the knob 22 disengages the gear-drive assembly 24 from the shaft so that manual rotation of the knobs 20 and 22 will cause a corresponding rotation of the shaft 18 and platen 16.

The platen feed assembly 14 forms no part of the present invention and thus will not be described in detail. It should be noted, however, that such assembly is of conventional variety and manufacture and details thereof may be obtained through a review of the aforementioned HyType I and II serial printers.

Still referring to FIG. 1, the carriage assembly 12 is mounted by a pair of bearing members 28 (only one shown) to a respective pair of rods 30 which are themselves mounted at each end to a main support frame 32 of the printer 10. The specific manner by which the bearing member 28 are mounted to the carriage will be described in more detail below. It should be noted at this point, however, that the bearing members are each preferably of the type disclosed in our co-pending U.S. application Ser. No. 588,995, filed on June 20, 1975 for CARRIAGE SUPPORT APPARATUS and assigned to the assignee of the present invention (now U.S. Pat. No. 3,985,404).

A drive motor 34 is coupled by a suitable cable-pulley arrangement 36 to the carriage assembly 12. As is conventional, the cable-pulley arrangement includes a first pulley (not shown) connected to the shaft of the drive motor 34, a plurality (e.g., 2 or 4) second pulleys 38 coupled to opposing sides of the machine frame 32 and a third pulley 40 connected to the carriage assembly 12 in a manner to be described in more detail below in connection with FIGS. 2 and 3. At least cable 41 is wrapped around the pulleys for imparting linear motion to the carriage assembly 12 along the rails 30 in response to rotation of the motor drive shaft. For more details of the specific cable-pulley arrangement shown in the drawings, reference may be had to the aforementioned HyType II serial printer. For an alternative approach, reference may be had to U.S. Pat. No. 3,872,960.

Figure 2:
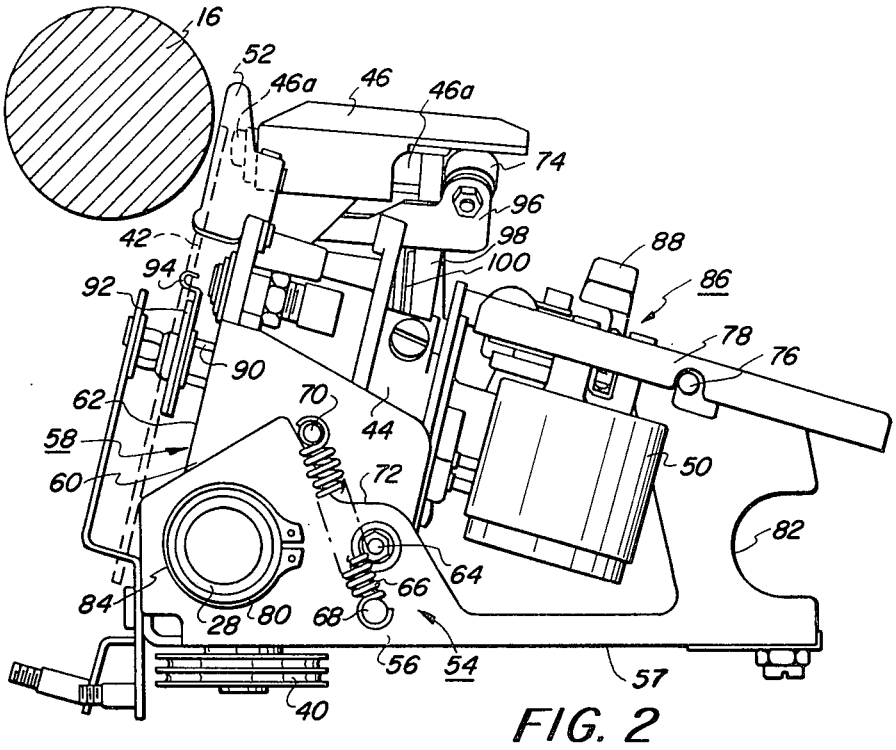
FIG. 2 is a side elevation view of the carriage assembly shown in FIG. 1 with a print wheel carried thereon (shown in phantom) at a first position relative to the adjacent support platen.

Referring now to FIGS. 1 and 2, the carriage assembly 12 generally includes and is adapted to transport a print wheel 42, which is preferably of the daisy wheel type and which is mounted for rotation about its axis, a drive motor 44 (FIG. 2 only) for controlling the direction and speed of rotation of the print wheel 42, a hammer assembly 46 for impacting an aligned character element on the print wheel against the adjacent support platen 16, a ribbon cartridge 48 (FIG. 1 only) for supplying inked ribbon (not shown) between the hammer assembly 46 and the platen 16, and a ribbon cartridge motor 50 (FIG. 2 only) for transporting ribbon in front of the hammer assembly along a pair of guides 52 (only one visible) during operation of the printer.

The specific nature of the hammer assembly 46 and ribbon cartridge 48 form no part of the present invention and thus will not be described in detail herein. However, details of a preferred hammer assembly are disclosed in co-pending U.S. application Ser. No. 664,797 filed concurrently herewith in the names of Mario G. Plaza and Michael C. Weisberg for HAMMER ASSEMBLY and assigned to the assignee of the present invention, and details of one type of a preferred ribbon cartridge that may be utilized in the printer 10 is disclosed in our co-pending U.S. application Ser. No. 633,530 filed on Nov. 19, 1975 for DUAL LEVEL RIBBON CARTRIDGE and assigned to the assignee of the present invention.

Figure 3:
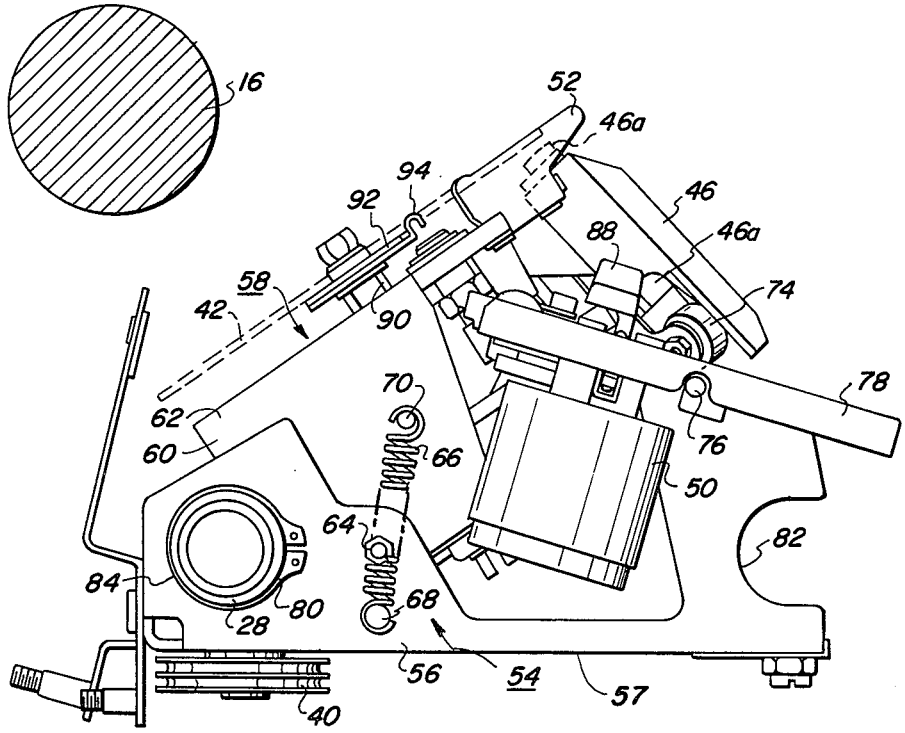
FIG. 3 is a side elevation view of the carriage assembly shown in FIG. 1 with a print wheel carriage thereon (again shown in phantom) at a second position relative to the adjacent support platen.

Referring specifically to FIGS. 2 and 3, the carriage assembly, 12 comprises an outer carriage section 54 having opposing side walls 56 (only and visible) and a lower floor 57. The assembly also comprises an inner carriage section 58 also having opposing side walls 60 (only one visible) and a front wall 62. The inner carriage section 58 is pivotably mounted at its side walls 60 to the side walls 56 of the outer carriage section 54 by means of a suitable pivot bolt 64 extending through the side walls 56 and 60. Coupled between each pair of adjacent side walls 56 and 60 is a biasing member, such as a helically wound spring 66 (only one visible). Each spring 66 is attached in tension between a pair of pin-like members 68 and 70 respectively projecting from the associated side walls 56 and 60. Each spring 66 is desirably "over-centered" in the sense that its center of mass is positioned above the axis of the pivot bolt 64. In this manner, the springs 66 will exert a forward and downward force when they are positioned forwardly of the bolt 64 in the manner shown in FIG. 2, and a rearward and downward force when they are positioned rearwardly of the bolt 64 in the manner shown in FIG. 3.

The inner carriage section 58 is capable of being pivoted between two positions. The first, shown in FIG. 2, is defined when each pin-like member 70 engages a stop in the form of an inclined portion of the upper surface 72 of the adjacent side wall 56 of outer carriage section 54. The inner carriage section is retained in this first position due to the biasing action of the springs 66 is described above in cooperation with the stops defined by upper surfaces 72. In a second pivotal position (FIG. 3), the inner carriage section 58 is pivoted clockwise until a hammer stop 74 mounted thereto and forming a portion of the hammer assembly 46 engages a pivot shaft 76 through an opening (not shown) in a ribbon cartridge base plate 78 which is mounted to a rearward portion of the side walls 56 of the outer carriage section 54. Again, the inner carriage section 58 will be retained in this second position due to the biasing action of the spring members 66 in cooperation with the stop defined by shaft 76. In the second pivotal position, the print wheel 42 is in a loading position and can be removed and replaced by another, whereas in the first pivotal position of the inner carriage section 58, the print wheel 42 is brought into operative positional relation relative to the platen 16, i.e., it is in a printing position.

As shown in FIGS. 2 and 3, the outer carriage section 54 has a pair of aligned openings 80 formed in the respective side walls 56 adjacent the front end of the carriage assembly 12 and a pair of aligned recesses 82 formed in the respective side walls 56 adjacent the rear end of the carriage assembly. The openings 80 are adapted to receive in locked relation a linear bearing assembly 28. The bearing assembly 28 is preferably locked in position to the outer carriage section 54 by at least one snap ring 84 fitted in an annular notch (not shown) in the bearing housing (see our above-mentioned U.S. application Ser. No. 588,995). A similar bearing assembly (not shown) is adapted to be similarly secured in the recesses 82 thereby enabling the carriage assembly 12 to be transported along the carriage rails 30 to desired printing positions.

Mounted to the outer carriage section 54 is a ribbon cartridge support and drive assembly 86 which includes the base plate 78 alluded to above, as well as a pair of latches 88 (only one visible) for locking the ribbon cartridge 48 in position on top of the base plate 78 in engagement with the drive shaft (not shown) of the motor 50, such motor also being included as part of the support and drive assembly 86. When driven, the motor 50 is capable of feeding ribbon along a path from the ribbon cartridge 48, along and in front of the pair of guides 52 mounted to the front wall 62 of the inner carriage section 58, and then back into the ribbon cartridge.

The print wheel motor 44 is also mounted by suitable means to the front wall 62 of the inner carriage section 58 for controlling the speed and direction of rotation of the print wheel 52 in order to bring a desired character element on the wheel to a stationary printing position in alignment with the platen 16 and the tip of a hammer element 46*a* included in the hammer assembly 46. The motor 44 has a spindle 90 projecting forwardly of the wall 62. A hub portion 92 forms part of the spindle and is adapted to be received in the central opening (not shown) of the daisy wheel type print wheel 42. An exemplary print wheel of this type is generally disclosed print wheel of this type is generally disclosed in copending U.S. application Ser. No. 505,105 filed on Sept. 11, 1974 in the name of Andrew Gabor for HIGH SPEED PRINTER WITH INTERMITTENT PRINT WHEEL AND CARRIAGE MOVEMENT and assigned to the assignee of the present invention (now U.S. Pat. No. 3,954,163). In order to prevent the print wheel 46 from moving relative to the spindle 90 during rotation thereof by the motor 44, a key member 94 forms part of the spindle and is adapted to be engaged in a keyway (not shown) included in the print wheel 42 (see again the print wheel disclosed in U.S. application Ser. No. 505,105).

Also mounted to the front wall 62 of the inner carriage section 58 is the hammer assembly 46, as well as a stop arm 96 having the hammer stop 74 bolted thereto. Interposed between the stop 74 and the rear end of the hammer element 46*a* is an armature 98 which forms part of a conventional electromagnetic actuating assembly 100. The armature 98 is normally in the position shown in FIGS. 2 and 3 until the electromagnetic assembly is actuated, at which time the armature is forced forwardly. Such forward movement of the armature 64 results in the free flight forward movement of the hammer element 46*a*. The hammer element will continue to "fly" forwardly until its front end, or tip, contacts the aligned character element on the print wheel 42 and forces it and any ribbon (not shown) disposed in front of the wheel on the guides 52 against a recording medium (not shown), such as paper, supported on the platen 16. In this regard, and as shown in FIG. 2, when the inner carriage section 58 is retained in its first position, the print wheel 42, hammer element 46*a* and the platen 16 will be in alignment.

What has been described, therefore, is a carriage assembly 12 for transporting a print wheel 42 along a predetermined path, as defined by the guide rails 30, adjacent a support platen 16. In accordance with the invention, the carriage assembly includes an outer carriage section 54 adapted to be mounted by the bearing members 28 to the rails 30 for movement along the predetermined path, an inner carriage section 58 for mounting the print wheel 42 to the first carriage section 54 for movement between first and second positions relative to the platen 16, and over-center springs 66 which cooperate with the stops defined by the surfaces 72 and the shaft 76 for retaining the print wheel in each of its first and second positions.

Although the invention has been described with respect to a presently preferred embodiment, it will be appreciated by those skilled in the art that various modifications, substitutions, etc. may be made without departing from the spirit and scope of the invention as defined by the following claims. For example, the use of tensioned helically wound springs 66, although presently preferred, is not essential, as it is obvious that other biasing means disposed in other locations on the carriage assembly could equally well be employed. As another example, the use of surfaces 72 and the shaft 74 as stops is not essential as other appropriate stops defined at other appropriate locations could be employed. Likewise, the pins 70 and hammer stop 74 need not essentially be the elements which engage such stops.

What is claimed is:

1. A carriage assembly for transporting a print member along a predetermined path adjacent a support member, comprising:

a first carriage section adapted to be mounted adjacent said support member for movement along said predetermined path;

means for mounting a print member to said first carriage section for movement between first and second positions relative to said support member; and means, coupled to said means for mounting, for retaining a print member mounted to said first carriage section in each of said first and second positions, said means for retaining including a dual biasing spring for biasing said print member in a direction opposite said second position when at said first position and for biasing said print member in a direction opposite said first position when at said second position.

2. The carriage assembly of claim 1, wherein said spring is operative to bias a print member mounted to said first carriage section in a direction toward said first position when located between said first position and a predetermined position intermediate said first and second positions, and is also operative to bias said print member in a direction toward said second position when located between said predetermined position and said second position.

3. The carriage assembly of claim 1, wherein said means for mounting comprises a second carriage section to which a print member may be mounted, said second carriage section being mounted to said first carriage section for movement between first and second positions, said print member being located at its first position when said second carriage section is moved to its first position, and said print member being located at its second position when said second carriage section is moved to its second position.

4. The carriage assembly of claim 3, wherein said spring is operative to bias said second carriage section in a direction toward its first position when located between its first position and a predetermined position intermediate its first and second positions, and is operative to bias said second carriage section in a direction toward its second position when located between said predetermined position and its second position.

5. The carriage assembly of claim 4, wherein said spring is coupled between said first and second carriage sections.

6. The carriage assembly of claim 5, wherein said spring is helically wound and coupled in tension between said first and second carriage sections.

7. The carriage assembly of claim 5, wherein said second carriage section is pivotally mounted to said first carriage section about a pivot line, and said spring has its center of mass spaced from said pivot line at least when said second carriage section is at its first and second positions.

8. The carriage assembly of claim 6, wherein said second carriage section is pivotably mounted to said first carriage section about a pivot line, and said spring has its center of mass spaced from said pivot line at least when said second carriage section is at its first and second positions.

* * * * *